US010321777B2

(12) United States Patent
Simmons-Ellis

(10) Patent No.: US 10,321,777 B2
(45) Date of Patent: Jun. 18, 2019

(54) DRAWSTRING TABLE COVER

(71) Applicant: Frances Simmons-Ellis, Chicago, IL (US)

(72) Inventor: Frances Simmons-Ellis, Chicago, IL (US)

( * ) Notice: Subject to any disclaimer, the term of this patent is extended or adjusted under 35 U.S.C. 154(b) by 0 days.

(21) Appl. No.: 15/608,092

(22) Filed: May 30, 2017

(65) Prior Publication Data

US 2018/0344061 A1 Dec. 6, 2018

(51) Int. Cl.
*A47G 11/00* (2006.01)
*A47G 21/16* (2006.01)

(52) U.S. Cl.
CPC ..... *A47G 11/004* (2013.01); *A47G 21/167* (2013.01)

(58) Field of Classification Search
CPC ..... B60N 2/60; A47C 31/11; A47C 31/10
USPC ..... 108/90; 150/158, 154; 297/228.11, 297/228.12
See application file for complete search history.

(56) References Cited

U.S. PATENT DOCUMENTS 1,142,571 A * 6/1915 Hoffberg ..... A47L 313/08 108/90
1,219,790 A * 3/1917 Taylor ..... A47B 13/08 108/90
3,003,816 A * 10/1961 Wilson ..... A47C 31/11 297/228.11
3,960,193 A * 6/1976 Davis ..... A47G 11/003 108/90
4,396,227 A * 8/1983 Neilson ..... B60N 2/609 297/228.11
4,789,019 A * 12/1988 Sweetser ..... A47G 11/004 108/90
4,938,607 A * 7/1990 Kelley ..... B65D 31/00 190/1
5,069,554 A * 12/1991 Bonnett ..... A47G 11/003 108/90
D339,710 S * 9/1993 Perna, Jr. ..... D6/608
5,333,921 A * 8/1994 Dinsmoor, III ..... A61G 5/1043 297/219.1
5,339,748 A * 8/1994 Bilotti ..... A47G 11/004 108/90
6,827,398 B2 * 12/2004 Nazginov ..... A47C 31/11 297/225
7,044,067 B2 * 5/2006 Saccomandi ..... A47G 11/003 108/90
7,082,883 B1 * 8/2006 Arias ..... A47C 7/66 108/90
7,178,864 B2 * 2/2007 Hsieh ..... A47C 5/06 297/228.11
8,500,199 B2 * 8/2013 Paulin ..... A47B 13/083 297/219.1
8,866,055 B2 * 10/2014 Davis ..... A47J 36/027 219/725
9,084,459 B2 * 7/2015 Fazackerley ..... A45C 13/1046
(Continued)

*Primary Examiner* — Jose V Chen
(74) *Attorney, Agent, or Firm* — DLA Piper LLP US

(57) ABSTRACT

A table cover may comprise a sheet, a drawstring housing, a drawstring disposed at least partially within the drawstring housing, and at least one slit in the sheet and/or the drawstring housing configured to accept at least one end of the drawstring. In some embodiments, the drawstring housing may be coupled to the sheet. In some embodiments, the drawstring housing may be detached from the sheet and attachable to the sheet.

6 Claims, 11 Drawing Sheets

(56) References Cited

U.S. PATENT DOCUMENTS

| | | | | |
|---|---|---|---|---|
| 2004/0194673 | A1* | 10/2004 | Comeaux | A47G 11/004<br>108/90 |
| 2005/0264057 | A1* | 12/2005 | Huse | A47C 7/021<br>297/228.11 |
| 2010/0224104 | A1* | 9/2010 | Swistun | A47G 11/004<br>108/90 |
| 2011/0100269 | A1* | 5/2011 | Hull | A47G 11/004<br>108/90 |
| 2011/0181083 | A1* | 7/2011 | Ulfig | B60N 2/58<br>297/218.1 |

* cited by examiner

DRAWSTRING TABLE COVER

DETAILED DESCRIPTION OF SEVERAL EMBODIMENTS

Systems and methods described herein may provide table covers with integrated drawstring elements according to some embodiments. Other embodiments may provide standalone drawstring elements that may be attached to and/or integrated with table covers. The drawstring may be configured to not only secure the table cover to a table top, but also to secure the table cover to one or more table legs.

Figure 1A:
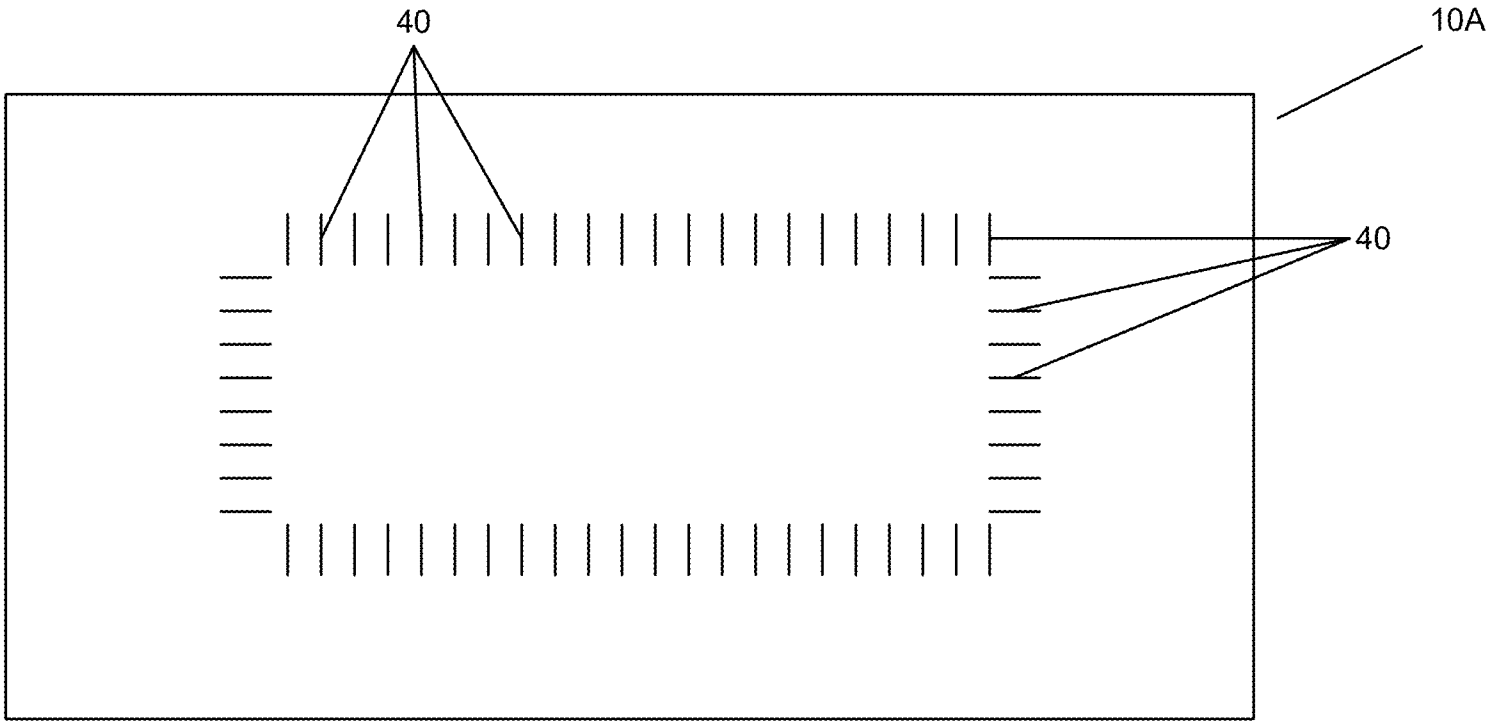
FIGS. 1A-1C are top views of table covers with drawstring housings according to embodiments of the invention.
Figure 1B:
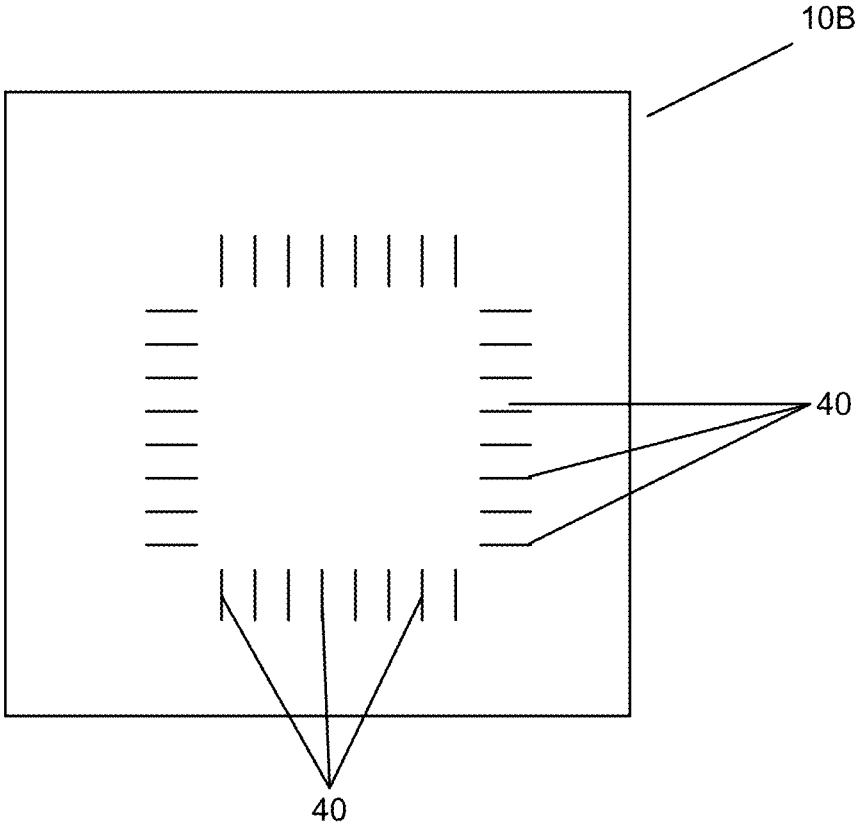
Figure 1C:
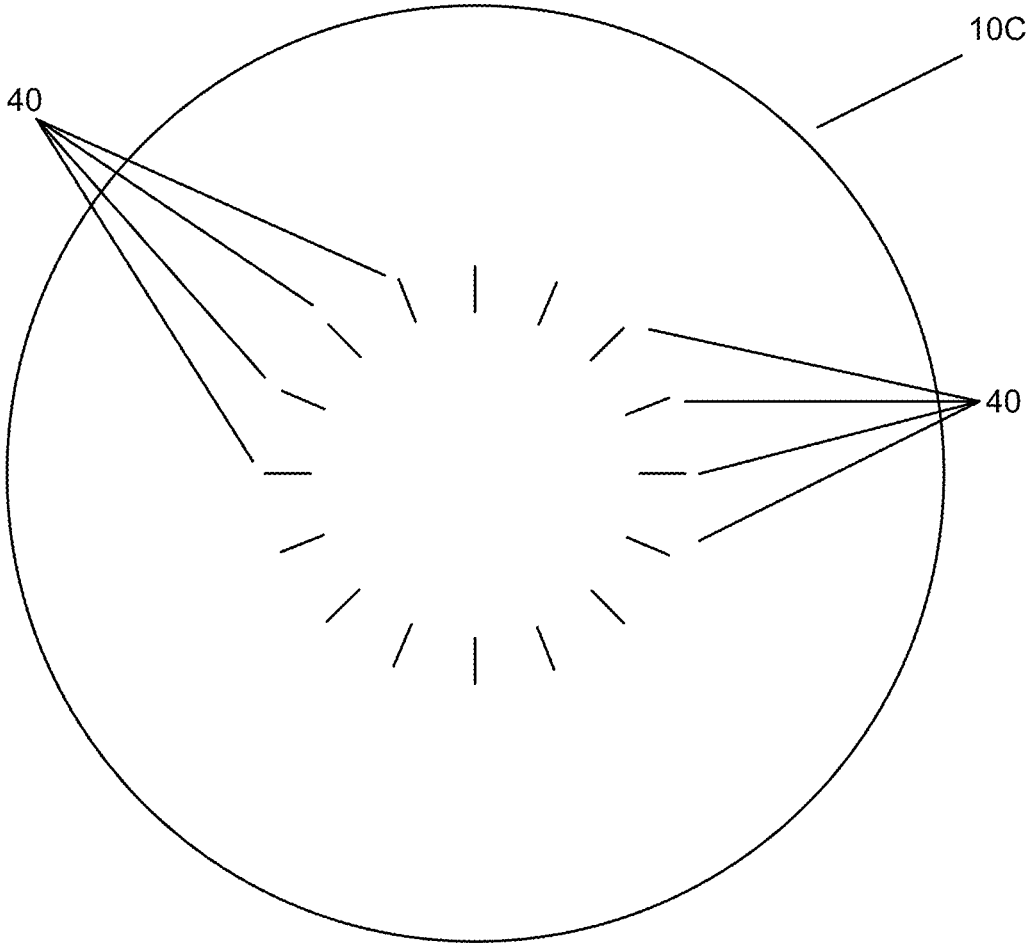

FIGS. 1A-1C are top views of table covers with drawstring housings according to embodiments of the invention. Specifically, FIG. 1A shows rectangular table cover 10A, FIG. 1B shows square table cover 10B, and FIG. 1C shows round table cover 10C. Table cover 10 may comprise a cloth or other sheet for covering a table. Table covers 10 may be made in any shape or size, and table covers 10A-10C are representative, but non-limiting, examples. For instance, table covers 10 may be oval, triangular, some other geometric shape (e.g., pentagonal, hexagonal, etc.), or customized to an irregularly-shaped table. Table covers 10 may be made from any material. For example, table covers 10 may be made from plastic, cloth, or any other material that can form a flexible sheet suitable for covering a table. Table covers 10A-10C of FIGS. 1A-1C include a plurality of slits 40 disposed inward from the edge(s) of table covers 10A-10C. The purpose and arrangement of slits 40 is described in greater detail with respect to FIG. 2 below.

Figure 2:
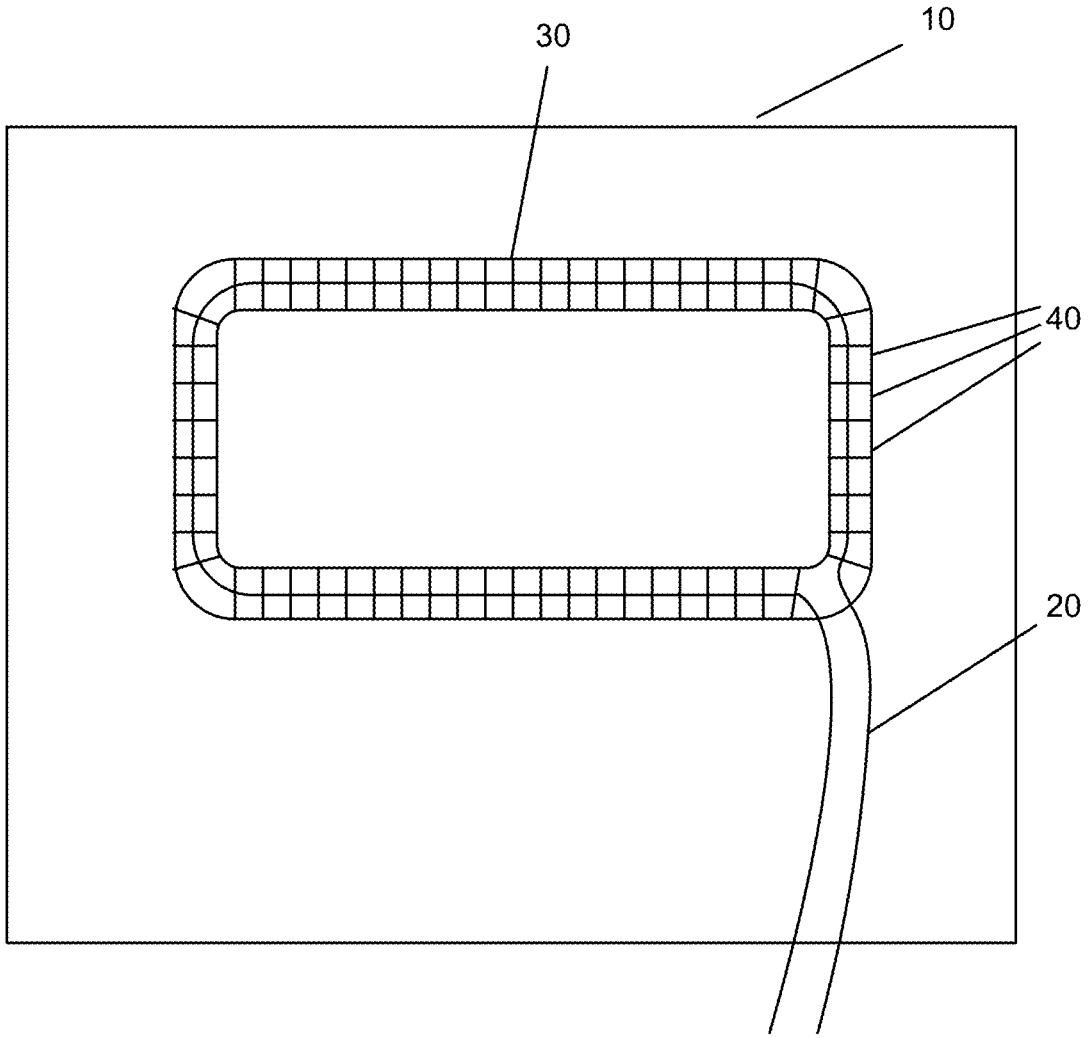
FIG. 2 is a top view of a table cover with drawstring according to an embodiment of the invention.
Figure 3:
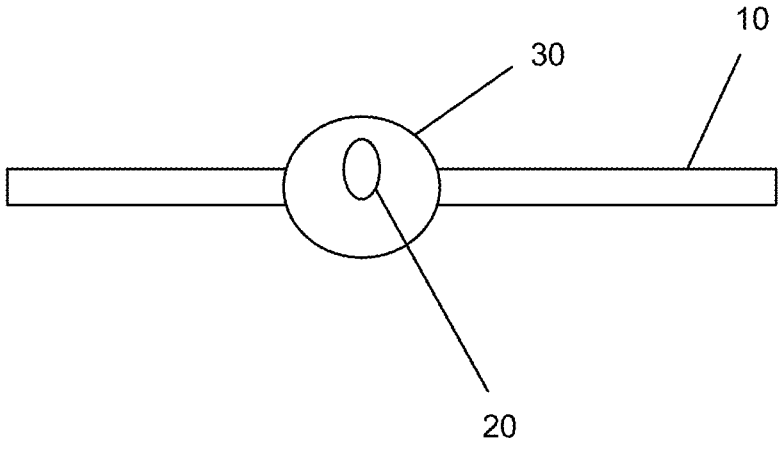
FIG. 3 is a cutaway view of a table cover with drawstring according to an embodiment of the invention.

Table cover 10 may include one or more drawstrings 20 which may be used to draw table cover 10 tight around the top of a table and may be tied to or around table legs to keep table cover 10 in place. FIG. 2 is a top view of table cover 10 with drawstring 20 according to an embodiment of the invention. Drawstring 20 may be contained within housing 30 (see FIG. 3 for a cutaway view of table cover 10 including drawstring 20 within housing 30). Housing 30 may be a hollow space within table cover 10 disposed inward from the edge(s) of table cover 10. Housing 30 may be equidistant from all edges of table cover 10 in some embodiments.

Housing 30 may be formed or constructed in a variety of ways. For example, housing 30 may comprise a tube or other hollow insert placed between fabric layers of table cover 10 or attached to the outside of table cover 10. Housing 30 may comprise a tube or other hollow insert formed by attaching an additional fabric piece or other element to the outside of table cover 10 such that the outside of table cover 10 forms one side of housing 30. Housing 30 may be formed by folding table cover 10 over on itself to form a space between layers of table cover 10 and attaching the folded layers of table cover 10 to one another. Housing 30 may be an open space between fabric layers of table cover 10 where the layers are separated from one another.

Drawstrings 20 may protrude from housing 30 and table cover 10 so that they can be pulled and tied around table legs. Housing 30 may include a plurality of slits 40. For embodiments wherein housing 30 is formed or placed inside table cover 10, the outer surface of table cover 10 may also include a plurality of slits 40 continuous with the plurality of slits 40 in housing 30 and therefore defining the same openings. The ends of drawstring 20 may be pulled through one or two of slits 40, as shown in FIG. 2. Some embodiments may include only a single slit 40 through which both ends of drawstring 20 protrude. Other embodiments may include two slits 40 through which each end of drawstring 20 respectively protrudes. However, other embodiments, such as the embodiment illustrated in FIG. 2, may include more than two slits 40 distributed at various locations along housing 30. Accordingly, the ends of drawstring 20 may be pulled out of slits 40 at various points along table cover 10 and used to secure table cover 10 to a table leg, for example. In some embodiments, printed lines may be provided instead of slits, and a user may be able to cut their own slits using the lines as a guide so they can pull drawstring 20 through at locations of their choosing. In some embodiments, housing 30 may contain multiple drawstrings 20 (e.g., three or four) so that a drawstring 20 may be tied to multiple legs of a table. The variable location of drawstring 20 ends may allow a user to easily secure table cover 10 to a table regardless of how that table's legs are arranged, as described in greater detail below.

Figure 4A:
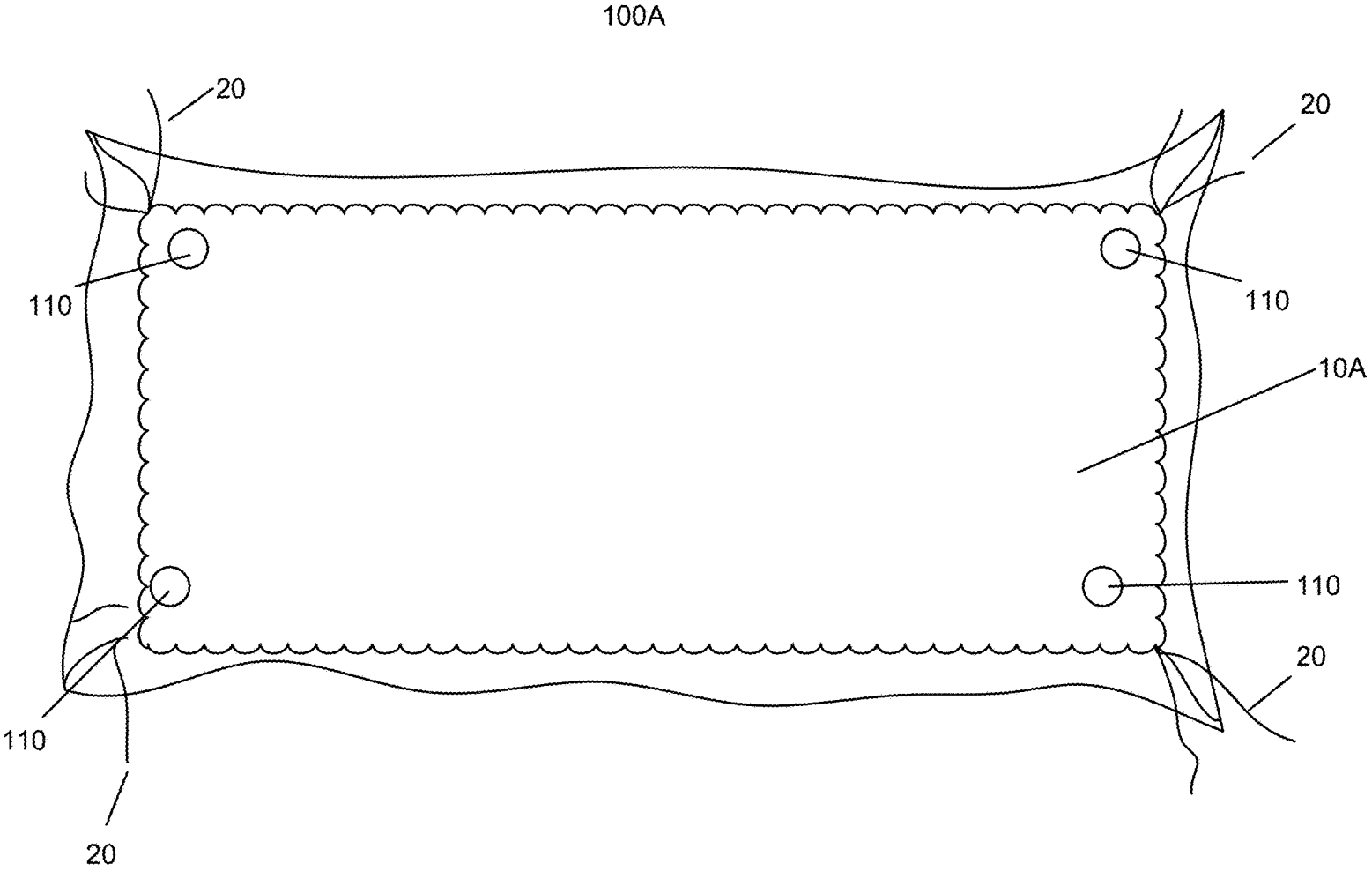
FIGS. 4A-4D are perspective views of table covers with drawstrings installed on tables according to embodiments of the invention.
Figure 4B:
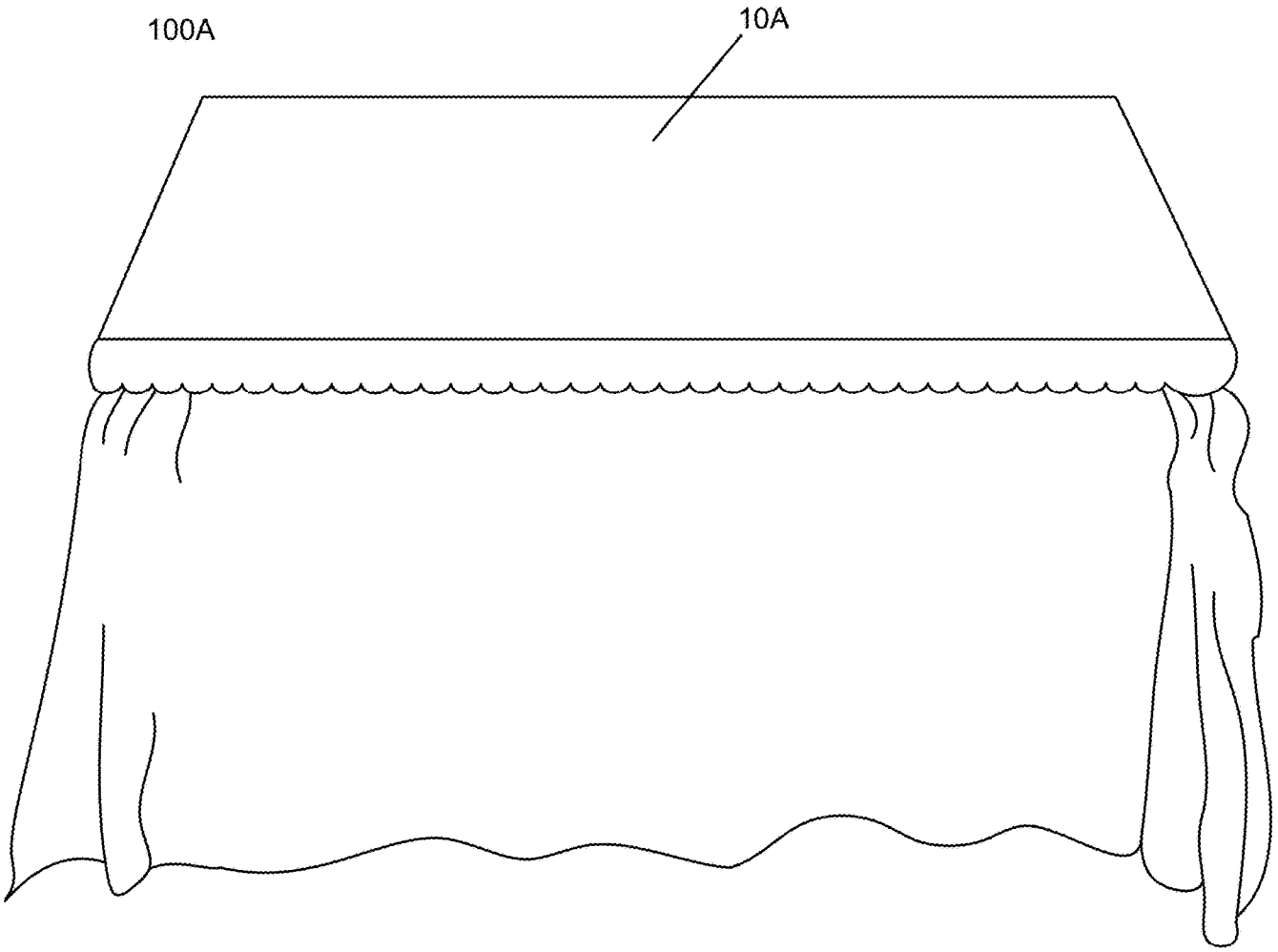
Figure 4C:
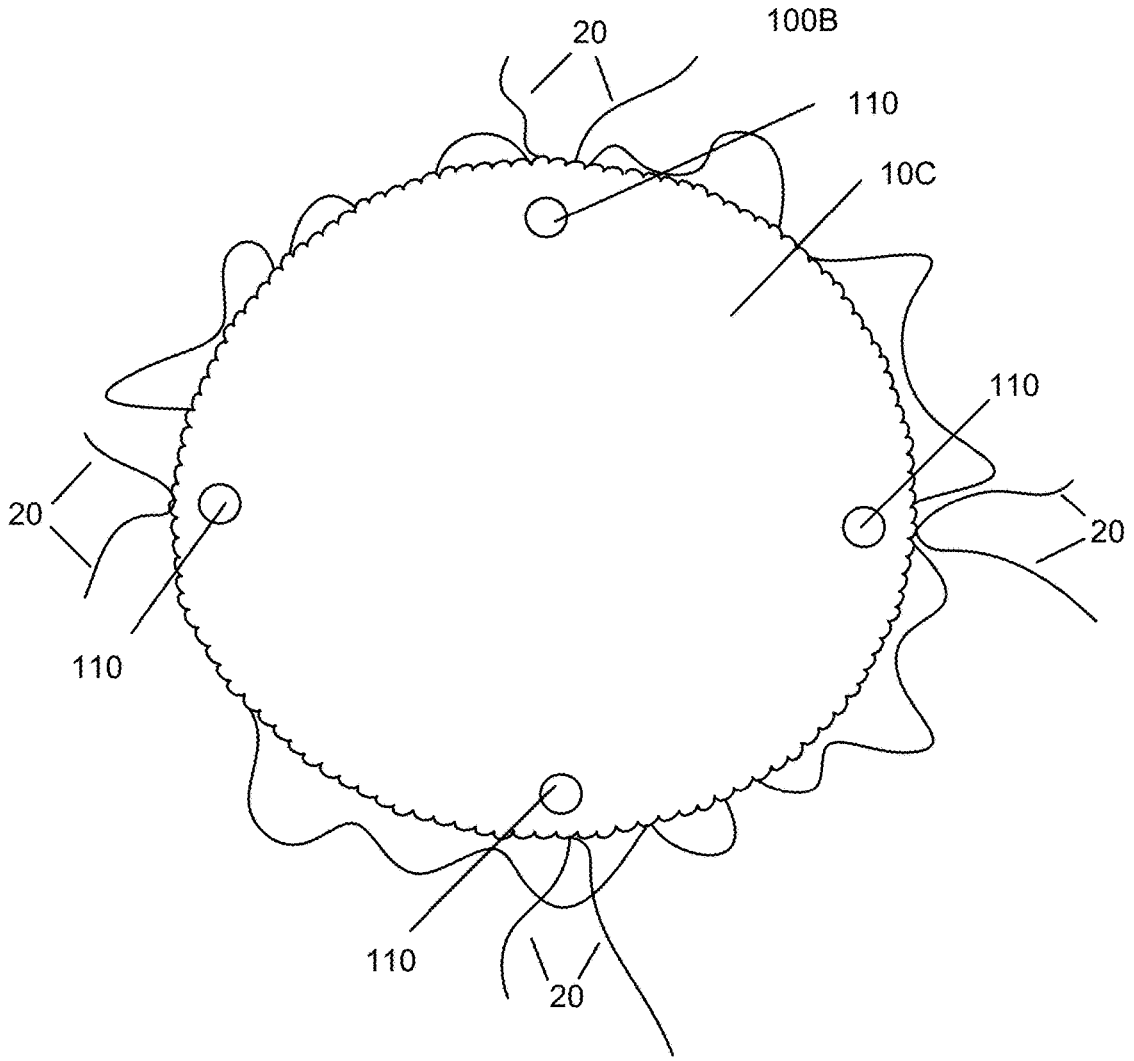
Figure 4D:
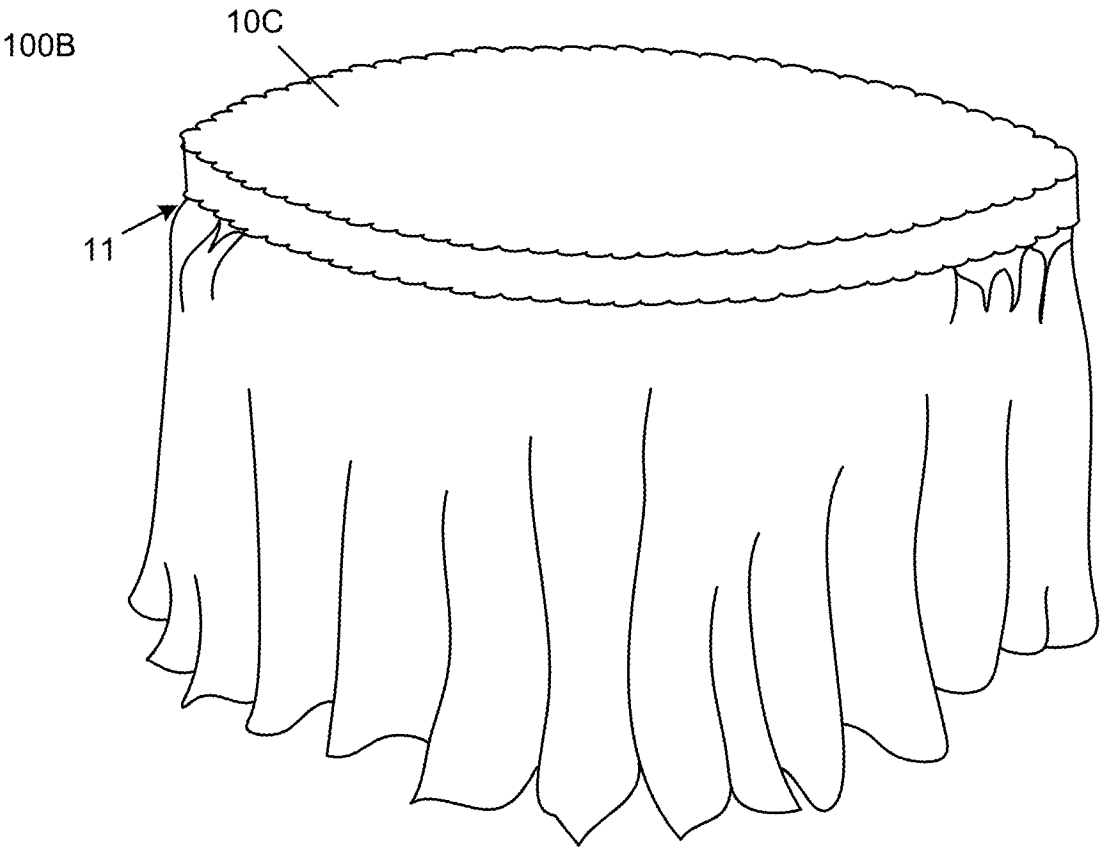

FIGS. 4A-4D are perspective views of table covers 10 with drawstrings 20 installed on tables according to embodiments of the invention. Table 100A of FIGS. 4A and 4B is rectangular and is covered by rectangular table cover 10A. Table 100B of FIGS. 4C and 4D is round and is covered by round table cover 10C. Of course, users may be able to apply table covers of different shapes to tables (e.g., use a round table cover for a rectangular table or vice versa). In either case, or for the case of differently-shaped tables, table cover 10 may work in the same way. A user may place table cover 10 over table 100 so that housing 30 surrounds the surface of table 100. The user may pull drawstring 20 to secure table cover 10 onto the surface of table 100. As shown in FIGS. 4B and 4D, this may cause table cover 10 to lie taut and smooth over the surface of table 100. Table cover 10 may cinch at surface region 11 around the surface of table 100. A user may be able to tie ends of drawstrings 20 around table legs 110 to secure table cover 10 to table 100.

As can be seen in FIGS. 4B and 4D, housing 30 may be disposed far enough inward from edge(s) of table cover 10 so that table cover 10 drapes downward from the surface of table 100 and substantially covers table legs 110. Housing 30 may be disposed far enough inward that free edge(s) of table cover 10 drape downward to a floor surface or downward some specified length from the table surface (e.g., 6 inches, 12 inches, or any other desired length substantial enough to provide a visual draping effect and cover at least a portion of table legs 110). For example, in some embodiments, table cover 10 may be sized to fit tables of a specific size. In one illustrative example, table cover 10 sized to fit a rectangular table with a surface size of 90"×120" may be 100"×130" to hang over the edge of the table. In other embodiments, table cover 10 may be larger still. For example, assuming the table with surface size of 90"×120" has its surface 30" above the floor, table cover 10 may be 150"×180" so it hangs to the floor when applied to the table.

Figure 5:
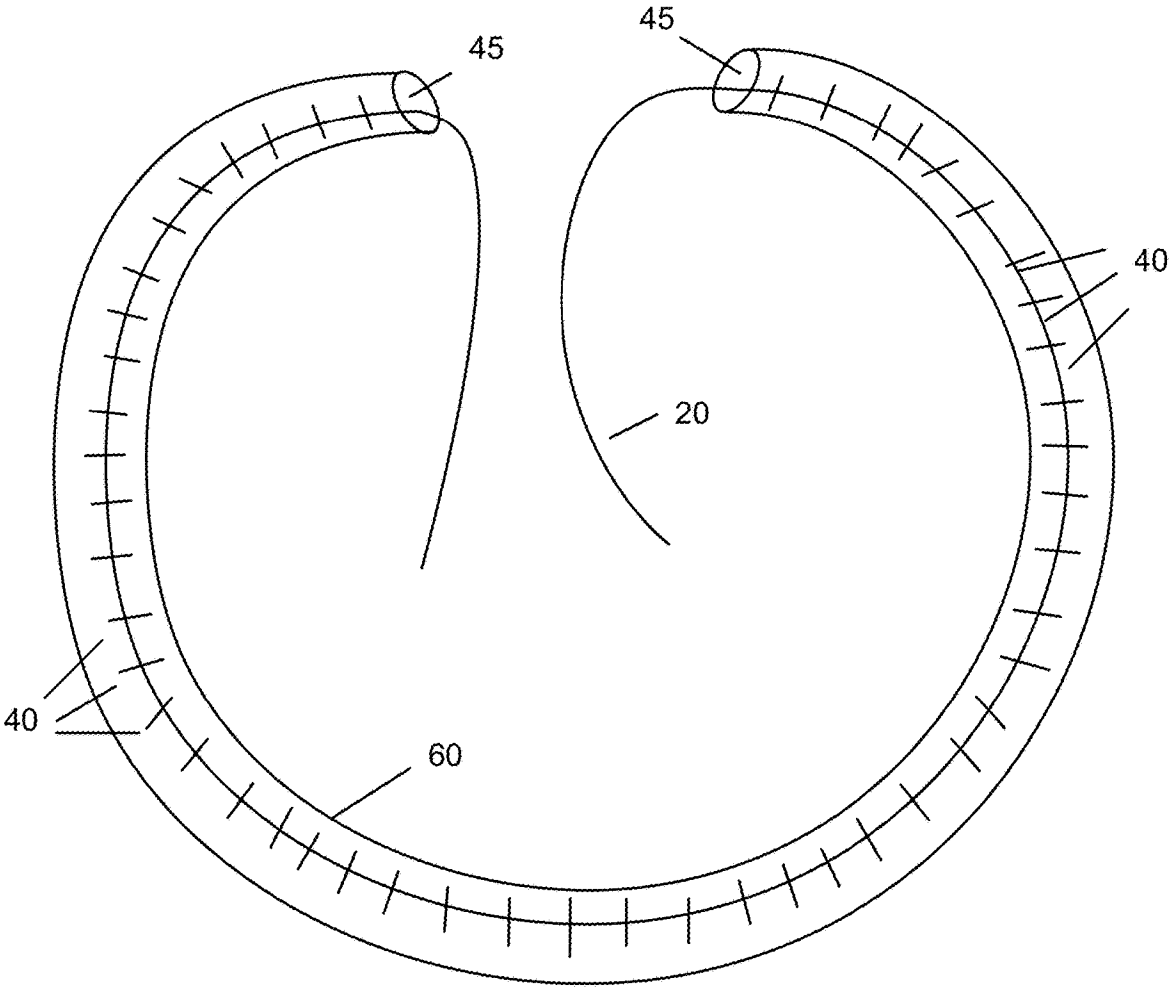
FIG. 5 is a perspective view of a drawstring housing according to an embodiment of the invention.
Figure 6:
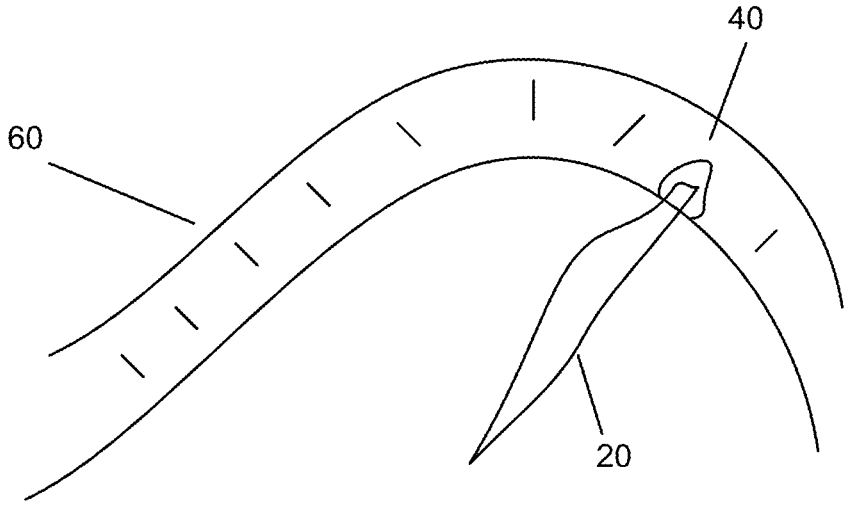
FIG. 6 is a perspective view of a drawstring housing according to an embodiment of the invention.

In some embodiments, a drawstring housing may be separate from and not integrated with any table cover. The separate drawstring housing may be attachable to a table cover to provide features similar to those of the integrated table cover 10 described above. FIG. 5 is a perspective view of a drawstring housing 60 according to an embodiment of the invention. Drawstring housing 60 may be a hollow tube or sleeve containing one or more drawstrings 20. Drawstring housing 60 may include a plurality of slits 40 along its length and, in some embodiments, end openings 45 at its ends. Drawstring 20 may be pulled out of end openings 45 as shown in FIG. 5 or through one or more of slits 40. FIG. 6 is a perspective view of a section of drawstring housing 60 illustrating drawstring 20 being pulled through one of slits 40 in detail.

Drawstring housing 60 may include an adhesive backing. A user may stick drawstring housing 60 to a table cover using the adhesive backing. For example, the adhesive backing may be applied to drawstring housing 60 and covered with a peel-away backing strip. A user may peel away the strip to reveal the adhesive and affix drawstring housing 60 to a table cover using the revealed adhesive. Other types of adhesive (e.g., glue, Velcro, etc.) may be used in other embodiments. Drawstring housing 60 may be flexible so that it can be stuck to the table cover in any arrangement. For example, FIG. 5 shows drawstring housing 60 in an oval configuration, but drawstring housing 60 may be bent to form a square, rectangle, circle, triangle, or other shape to conform to the shape of a table.

Once attached to a table cover, drawstring housing 60 may be used in much the same way as shown in FIGS. 4A-4D. Specifically, a user may place the table cover with drawstring housing 60 attached over a table and pull drawstring 20 to cause the table cover to lie taut and flat over the surface of the table. The user may pull drawstring 20 through one or more slits 40 or end openings 45 and tie drawstring 20 to one or more table legs to secure the table cover to the table.

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. For example, other steps may be provided, or steps may be eliminated, from the described flows, and other components may be added to, or removed from, the described systems. Accordingly, other implementations are within the scope of the following claims.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

What is claimed is:

1. A table cover comprising:

a sheet comprising an upper surface and a lower surface;

a drawstring housing integrated with the sheet so that the lower surface of the sheet defines a first outer surface of the drawstring housing, the drawstring housing further including a second outer surface not defined by the lower surface of the sheet, the drawstring housing being disposed radially inward from an edge of the sheet in a ring-shaped arrangement wherein at least one of the first outer surface and the second outer surface is in a plane parallel to the sheet;

a drawstring disposed at least partially within the drawstring housing; and a plurality of slits in the sheet and/or the drawstring housing disposed at intervals along the drawstring housing and configured to accept at least one end of the drawstring.

2. The table cover of claim 1, wherein the drawstring housing is formed between the lower surface of the sheet and the upper surface of the sheet.

3. The table cover of claim 1, wherein a flat outer surface of the drawstring housing is attached to an outside and parallel to the lower surface of the sheet or the upper surface of the sheet.

4. A drawstring housing comprising:

a flexible sleeve including a first outer surface and a second outer surface;

a drawstring disposed at least partially within the flexible sleeve; and a plurality of slits in the drawstring housing disposed at intervals along the flexible sleeve and configured to accept at least one end of the drawstring, wherein:

the drawstring housing is configured for the first outer surface to be attached to a lower surface of a table cover comprising an upper surface and the lower surface so that the drawstring in the drawstring housing lies in a ring-shaped arrangement with the first outer surface in a plane parallel to the table cover and is disposed radially inward from an edge of the sheet.

5. The drawstring housing of claim 4, further comprising an adhesive disposed on the first outer surface of the flexible sleeve.

6. The drawstring housing of claim 4, further comprising at least one opening at an end of the flexible sleeve.

* * * * *